United States Patent [19]

Suzuki et al.

[11] Patent Number: 4,740,323

[45] Date of Patent: Apr. 26, 1988

[54] METHOD OF LUBRICATING WORKING MACHINERY

[75] Inventors: Isoo Suzuki, Tokyo; Hideo Kanamori; Katsumi Hashimoto, both of Ichihara; Yasusi Aida, Hiroshima; Kohei Nakatani; Toshiyuki Harada, both of Kure, all of Japan

[73] Assignee: Idemitsu Kosan Company Limited, Tokyo, Japan

[21] Appl. No.: 807,364

[22] Filed: Dec. 10, 1985

[30] Foreign Application Priority Data

Dec. 14, 1984 [JP] Japan ..... 59-262919

[51] Int. Cl.[4] ..... C10M 173/00

[52] U.S. Cl. ..... 252/49.5; 252/12; 252/32.7 R; 252/45; 252/49.8; 408/56; 409/135; 409/136; 29/DIG. 72; 29/DIG. 74; 29/DIG. 87

[58] Field of Search ..... 252/12, 49.5, 32.7 R; 408/56; 409/135, 136; 29/DIG. 87, DIG. 72, DIG. 74

[56] References Cited

U.S. PATENT DOCUMENTS

| | | | |
|---|---|---|---|
| 1,789,841 | 1/1931 | Rennick | 408/56 |
| 3,268,447 | 8/1966 | Dickey et al. | 252/49.5 |
| 3,507,792 | 4/1970 | Zuraw | 252/49.5 |
| 3,518,917 | 7/1970 | Sluhan | 408/56 |
| 3,836,467 | 9/1974 | Jones | 252/49.5 |
| 4,354,949 | 10/1982 | Eggers et al. | 252/49.5 |
| 4,371,447 | 2/1983 | Webb et al. | 252/49.5 |
| 4,384,965 | 5/1983 | Hellsten et al. | 252/49.5 |
| 4,448,703 | 5/1984 | Forsberg | 252/49.5 |

FOREIGN PATENT DOCUMENTS

| | | | |
|---|---|---|---|
| 1365332 | 8/1974 | United Kingdom | 408/56 |
| 2010137 | 6/1979 | United Kingdom | 409/136 |
| 560732 | 6/1977 | U.S.S.R. | 408/56 |

OTHER PUBLICATIONS

Smalheer & Smith, "Lubricant Additives", 1967, pp. 9–10.

*Primary Examiner*—William R. Dixon, Jr.
*Assistant Examiner*—Ellen McAvoy
*Attorney, Agent, or Firm*—Frishauf, Holtz, Goodman & Woodward

[57] ABSTRACT

A method of lubricating a metal working machine which has (i) at least one sliding machine surface requiring lubrication and (ii) a metal working section wherein metal is worked in contact with a metal working fluid, said method comprises applying a lubricating oil composition to said at least one sliding surface and using as said metal working fluid an aqueous working fluid composition comprising said lubricating oil composition diluted with water, the ratio of water to said lubricating oil composition being at least 3 to 1, said lubricating oil composition comprising:

(A) 10 to 90% by weight of at least one oil selected from the group consisting of a mineral oil and a synthetic oil, (B) 0 to 30% by weight of at least one extreme pressure additive selected from the group consisting of sulfurized fat and oil, a phosphate, a phosphite, and an amine salt of phosphate or phosphite and (C) 10 to 60% by weight of an emulsifying agent selected from the group consisting of an anionic surface active agent, a cationic surface active agent, a nonionic surface active agent and a phosphorus-containing surface active agent, and said lubricating oil composition having a coefficient of dynamic friction of less than 0.2.

13 Claims, No Drawings

METHOD OF LUBRICATING WORKING MACHINERY

BACKGROUND OF THE INVENTION

The present invention relates to a method of lubricating working machinery, and more particularly, to a method of lubricating working machinery in which even if a sliding surface oil used for lubrication of working machinery intermingles with a metal working oil, no trouble results.

A variety of lubricating oils having different characteristics are used in working machinery depending on the application part and the purpose of use. When, however, these lubricating oils intermingle with each other, there is a danger of reduction in their lubricating characteristics and occurrence of a fatal problem. Thus such intermingling is absolutely necessary to avoid.

In many working machines, particularly a transfer machine, however, a sliding surface oil often intermingles with a metal working oil such as a cutting oil and a grinding oil. In this case, if the metal working oil is of the aqueous emulsion type, the following problems arise.

(1) The metal working oil loses its uniformity of lubricating properties. For this reason, its metal working performance varies and it becomes impossible to accomplish high accuracy metal working.

(2) Decomposition is accelerated, and the service life of the metal working liquid is seriously reduced.

The present inventors have made extensive investigations to overcome the above problems.

As a result, it has been found that if a lubricating oil having a specific formulation and a specific coefficient of dynamic friction is applied to a sliding surface of working machinery, and a dilution of the lubricating oil composition is applied to a metal working section of the working machinery, the above problems can be overcome. Based on these findings, the present invention has been accomplished.

SUMMARY OF THE INVENTION

An object of the present invention is to provide a method of lubricating working machinery, which method avoids the problems encountered in conventional lubrication, such as a reduction in metal working performance of the working machinery and a serious decrease in the service life of the metal working oil.

The present invention relates to a method of lubricating a working machine which comprises applying a lubricating oil composition to a sliding surface of the working machine and applying a dilution of the lubricating oil composition to a metal working section of the working machine, said composition comprising;

(A) 10 to 90% by weight of at least one oil selected from the group consisting of a mineral oil and a synthetic oil, (B) 0 to 30% by weight of an extreme pressure additive and (C) 10 to 60% by weight of an emulsifying agent, and having a coefficient of dynamic friction of less than 0.2.

DETAILED DESCRIPTION OF THE INVENTION

Component (A) of the lubricating oil composition in the present invention is at least one oil selected from the group consisting of a mineral oil and a synthetic oil. This component (A) is the base material of the lubricating oil composition. These are no special limitations to these mineral and synthetic oils. It is, however, preferred to use a mineral oil and/or a synthetic oil having a viscosity of 1.5 to 250 centistokes (cst), preferably 5 to 100 cst as determined at 40° C. Typical examples of the mineral oil are a lubricating oil fraction of naphthenic, intermediate and paraffinic mineral oils, and a high aromatic component as obtained by decomposition of such mineral oils. Typical examples of the synthetic oil are long chain alkylbenzene, branched alkylbenzene, polyolefins such as polybutene, alkylnaphthalenes, ester, and polyglycols. Of these compounds, a naphthenic mineral oil is preferred. The above oils can be used alone or in combination with each other.

The amount of the mineral oil and/or a synthetic oil compounded is 10 to 90% by weight, preferably 50 to 70% by weight based on the total weight of the composition. If the amount of the mineral oil and/or a synthetic oil compounded is less than 10% by weight, it is difficult to control the viscosity of the lubricating oil composition and when the lubricating oil composition is used in a metal working part, corrosion is liable to occur.

As the component (B) of the lubricating oil composition in the present invention, an extreme pressure additive is used. There are no special limitations to the extreme pressure additive. Typical examples of the extreme pressure additive are sulfurized fats and oils such as sulfurized lard, sulfurized sperm oil, and sulfurized castor oil; phosphates such as tributyl phosphate, tricresyl phosphate, trioctyl phosphate, triphenyl phosphate, lauryl acid phosphate, and oleyl acid phosphate; phosphites such as di-lauryl hydrogen phosphite and di-oleyl hydrogen phosphite; and amine salts of phosphates or phosphites such as beef tallow amine salt of octyl acid phosphate or di-lauryl hydrogen phosphite, and oleylamine salt of oleyl acid phosphate or di-oleyl hydrogen phosphite. These compound can be used alone or in combination with each other. Of these compounds, a mixture of sulfurized fats and oils, and phosphate is preferred.

The amount of the extreme pressure additive compounded is 0 to 30% by weight, preferably 5 to 20% by weight based on the total weight of the composition. When the extreme pressure additive is compounded in an amount less than 5% by weight, it is preferred to use a phosphorus-containing surface active agent as an emulsifying agent. This surface active agent imparts the lubricating oil composition with the following properties. One is that the composition when applied to a sliding surface prevents the occurrence of stick slip, and the other is that the composition when applied to a metal working section in a diluted form prevents a reduction in cutting properties. On the other hand, if the amount of the extreme pressure additive compounded is in excess of 30% by weight, undesirable problems arise in that oil stains are readily formed when the composition is used as a sliding surface oil and in that when the composition is used as a metal working oil, the metal is easily rusted and decomposition of the composition is accelerated.

As the component (C) of the oil lubricating composition in the present invention, an emulsifying agent is used. There are no special limitations to the emulsifying agent. Typical examples of the emulsifying agent are anionic surface active agents such as fatty acid soap, naphthenic acid soap and sulfate; cationic surface active agents such as long chain primary amine salts, and alkyltrimethyl ammonium salts; and nonionic surface active agents such as polyoxyethylene alkyl ether, polyoxyethylene alkylphenyl ether, polyoxyethylene alkyl ester, and polyoxyethylene alkylphenyl ester. In addition, phosphorus-containing surface active agents such as dipolyoxyethylene alkyl ether phosphate, dipolyoxyethylene alkylphenyl ether phosphate, tripolyoxyethylene alkyl ether phosphate, and tripolyoxyethylene alkylphenyl ether phosphate can be used.

The amount of the emulsifying agent compounded is 10 to 60% by weight, preferably 20 to 40% by weight based on the total weight of the composition. If the amount of the emulsifying agent compounded is less than 10% by weight, the emulsion stability of the metal working solution is poor, and so it cannot be used in metal working. On the other hand, if the amount of the emulsifying agent used is in excess of 60% by weight, the coefficient of dynamic friction in the Sliding Surface Test becomes undesirably high and stick slip is undesirably produced when the composition is applied to a sliding surface of the working machine.

If necessary, an antioxidant, a metal deactivator, a defoaming agent, a disinfectant, and so forth can be added to the lubricating oil composition in the present invention.

The lubricating oil composition in the present invention is prepared by mixing the above components.

The lubricating oil composition in the present invention comprises the above components and has a coefficient of dynamic friction at a sliding speed of about 12 mm/min as determined by the sliding surface test of less than 0.20. If the coefficient of dynamic friction is not less than 0.20, undesirable problems arise in that stick slip is produced and working accuracy is decreased.

In accordance with the lubricating method of the present invention, the above lubricating oil composition is applied to a sliding surface of a working machine, and a dilution of the lubricating oil composition is applied to a metal working section of the working machine. The working machine to which the lubricating oil composition in the present invention is applied is a machine equipped with a sliding surface and a metal working section. A typical example of such working machines is a transfer machine in which a sliding surface oil readily intermingles with a metal working oil because of its structure.

The lubricating oil composition in the present invention when applied to a sliding surface of working machinery is used as such. On the other hand, when applied to the metal working section for cutting and grinding, for example, a diluted form of the lubricating oil composition is used in the form of a diluted form. In preparation of the dilution, water is used as the diluent and the degree of dilution is about 3 to 100 times and preferably about 20 to 50 times.

Since the lubricating oil composition in the present invention acts as a sliding surface oil and a metal working oil, even if the sliding surface oil intermingles with the metal working oil, the problems encountered in the conventional lubrication, such as a reduction in metal working performance of the working machine and a serious decrease in the service life of the metal working oil, do not occur. Thus the lubricating method of the present invention is especially effective when applied to a machine of the type that a metal working oil is used in a recycle system.

Although the lubricating oil composition in the present invention is of the emulsion type, it exhibits good lubricating characteristics free from stick slip even when applied to the sliding surface of the working machine. It also permits high accuracy metal working even when applied to the metal working section of the working machine.

Accordingly the lubricating method of the present invention is useful for lubrication of working machinery, particularly a transfer machine.

The present invention is described in greater detail with reference to the following examples.

EXAMPLES 1 TO 5, AND COMPARATIVE EXAMPLES 1 TO 4

Lubricating oil compositions having the formulations shown in Table 1 were prepared.

Each lubricating oil composition was measured for performance as a sliding surface oil and performance as a metal working oil by the testing methods described below. The results are shown in Table 1.

(1) Sliding Surface Test

The coefficient of dynamic friction ($\mu$) and formation of stick slip were measured by the Idemitsu method (a modification of ASTM D 2877-70, which is carried out under conditions as described below (see Idemitsu TRIBO Review, Vol. 1, No. p. 141–144)).

Measuring Conditions

Surface pressure: 0.54 kg/cm$^2$

Sliding speed: 12 mm/min

Material of sliding surface:

Bed made by polishing steel plate named S45C of JIS G4051

Saddle of plate (named FC-20 of JIS G5501) with a scraped surface.

(2) Test of Initial Emulsifying Property and Test of Solubility

In a 100-milliliter measuring cylinder were placed 97 milliliters of water, and 3 milliliters of the lubricating oil composition sample were dropped. After 30 minutes, it was examined to observe whether the oil sample floated or separated on the top of the water (the initial emulsifying property). When the oil sample was dispersed or dissolved in water, the volume of the oil sample which became dispersed or dissolved was measured (solubility). For the lubricating oil composition to be used in the present invention it is required that it should not separate to form a top layer and the volume of the oil composition dispersed or dissolved is at least 30 milliliters.

(3) Cutting Test

A cemented carbide tip (named P20 of JIS B4104) was mounted on a lathe and cut, and cutting tool wear was measured. The sample was a 30% emulsion. Cutting conditions were as follows:

Cutting speed: 100 m/min

Feed: 0.1 mm/rev.

Depth of cut: 2 mm

Distance of cut: 4,800 m.

TABLE 1

| | Example | | | | | Comparative Example | | | |
|---|---|---|---|---|---|---|---|---|---|
| | 1 | 2 | 3 | 4 | 5 | 1 | 2 | 3 | 4 |
| Composition (% by weight) | | | | | | | | | |

TABLE 1-continued

| | Example | | | | | Comparative Example | | | |
|---|---|---|---|---|---|---|---|---|---|
| | 1 | 2 | 3 | 4 | 5 | 1 | 2 | 3 | 4 |
| Component (A) | | | | | | | | | |
| 120 Machine Oil *1 | 62 | 65 | — | — | 65 | 94 | 27 | 35 | 87 |
| Synthetic Oil *2 | — | — | 61 | 66 | — | — | — | — | — |
| Component (B) | | | | | | | | | |
| Sulfurized Lard | 3 | 8 | 4 | 4 | — | 3 | 3 | 35 | 3 |
| Phosphate | 5 | 2 | 5 | 6 | — | 3 | 5 | — | 5 |
| Component (C) | | | | | | | | | |
| Emulsifying Agent *3 | 30 | 25 | 30 | 25 | 35*4 | — | 65 | 30 | 5 |
| Coefficient of Dynamic Friction | 0.15 | 0.16 | 0.16 | 0.17 | 0.18 | 0.11 | 0.18–0.25 | 0.16 | 0.15 |
| Characteristics | | | | | | | | | |
| Sliding Surface Test (Formation of Stick Slip) | None | None | None | None | None | None | Formed | None | None |
| Test of Initial Emulsifying Property (Presence of Oil layer) | No | No | No | No | No | Yes (3 ml) | No | No | Yes (2 ml) |
| Test of Solubility (ml) | 70 | 60 | 70 | 60 | 60 | 0 | 70 | 70 | 5 |
| Cutting Test Flank Wear (mg) | 65 | 50 | 62 | 60 | 75 | Impossible (Separation) | 66 | 50 | 60 |
| Remarks | | | | | | | | *5 | *6 |

Note:
*1Flash point: 190° C. Kinetic Viscosity at 40° C.: 55 cst
*2α-Olefin oligomer (viscosity at 100° C.: 8 centistokes)
*3Mixture of nearly equal amounts by weight of polyoxyethylene nonylphenyl ether (n = 4), polyoxyethylene nonylphenyl ether (n = 8) and sodium alkyl sulfate having a weight average molecular weight of about 550 (n: average number of moles of added ethylene oxide)
*4Dipolyoxyethylene lauryl ether phosphate
*5This lubricating oil composition cannot be used as a metal working oil since the decomposition of the composition is large and the metal is easily rusted.
*6This lubricating oil composition cannot be used as a metal working oil since the emulsion stability of the composition is poor.

What is claimed is:

1. A method of lubricating a metal working machine which has (i) at least one sliding machine surface requiring lubrication (ii) a metal working section wherein metal is worked in contact with a metal working fluid, and, wherein the operation of said machine causes the sliding machine surface lubrication to mix with the metal working fluid said method comprises applying a lubricating oil composition to said at least one sliding surface and using as said metal working fluid an aqueous working fluid composition comprising said lubricating oil composition diluted with water, the ratio of water to said lubricating oil composition being at least 3 to 1, said lubricating oil composition comprising:

(A) 10 to 90% by weight of at least one oil selected from the group consisting of a mineral oil and a synthetic oil.

(B) 5 to 20% by weight of at least one extreme pressure additive selected from the group consisting of sulfurized fat and oil, a phosphate, and phosphite, and an amine salt of phosphate or phosphite and (C) 10 to 60% by weight of an emulsifying agent selected from the group consisting of an anionic surface active agent, a cationic surface active agent, a nonionic surface active agent and a phosphorus-containing surface active agent, and said lubricating oil composition having a coefficient of dynamic friction of less than 0.2.

2. The method of claim 1, wherein said ratio is from 3 to 1 to 100 to 1.

3. The method of claim 1, wherein said Component (A) is a naphthenic mineral oil.

4. The method of claim 1, wherein said Component (A) is an oil having a viscosity of 1.5 to 250 centistokes determined at 40° C.

5. The method of claim 1, wherein said Component (C) is a phosphorus-containing surface active agent.

6. The method of claim 1, wherein said ratio is from 20 to 1 to 50 to 1.

7. The method of claim 6, wherein said Component (A) is in an amount of from 50 to 70%, and said Component (C) is in an amount of from 20 to 40%.

8. The method of claim 7, wherein said Component (A) is an oil having a viscosity of 1.5 to 250 centistokes determined at 40° C.

9. The method of claim 8, wherein said Component (A) is a naphthenic mineral oil.

10. The method of claim 1, wherein said working machine is a transfer machine.

11. The method of claim 6, wherein said Component (A) is a napthenic mineral oil having a viscosity of 1.5 to 250 centistokes determined at 40° C. and said Component (B) is a sulfurized lard phosphate.

12. The method of claim 11, wherein said Component (C) is a mixture of polyoxyethylene nonylphenyl ether having an average of four moles of added ethylene oxide, polyoxyethylene nonylphenyl ether having an average of eight moles of added ethylene oxide and sodium alkyl sulfate having a weight average molecular weight of about 550.

13. The method of claim 5, wherein said Component (C) is dipolyoxyethylene lauryl ether phosphate.

* * * * *